US006535711B2

(12) United States Patent
Rohde et al.

(10) Patent No.: US 6,535,711 B2
(45) Date of Patent: Mar. 18, 2003

(54) PROCESS FOR THE DOUBLE-SIDED PRINTING AND/OR COATING OF A SUBSTRATE

(75) Inventors: Domingo Rohde, Kiel (DE); Detlef Schulze-Hagenest, Molfsee (DE)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/021,413

(22) Filed: Dec. 6, 2001

(65) Prior Publication Data

US 2002/0141791 A1 Oct. 3, 2002

(30) Foreign Application Priority Data

Dec. 22, 2000 (DE) ..... 100 64 560

(51) Int. Cl.[7] ..... G03G 15/20; G03G 13/20

(52) U.S. Cl. ..... 399/306; 399/336; 399/411; 430/124

(58) Field of Search ..... 399/306, 329, 399/335, 336, 337, 411; 430/120, 124; 219/216

(56) References Cited

U.S. PATENT DOCUMENTS 5,572,311 A * 11/1996 Abe et al. ..... 399/411 X
5,778,294 A * 7/1998 Hiraoka et al. ..... 399/329
5,835,836 A 11/1998 Hirao ..... 399/336
5,999,788 A * 12/1999 Kanesawa et al. ..... 399/329
6,020,102 A * 2/2000 Fujimoto et al. ..... 430/120 X
6,032,015 A 2/2000 Umeda et al. ..... 399/306
6,320,642 B1 * 11/2001 Ogawa et al. ..... 399/335 X
6,342,689 B1 * 1/2002 Ishigaki et al. ..... 219/216

FOREIGN PATENT DOCUMENTS

JP 7-13449 * 1/1995
WO 92 / 06 417 A1 4/1992

* cited by examiner

*Primary Examiner*—Fred L. Braun
(74) *Attorney, Agent, or Firm*—Lawrence A. Kessler

(57) ABSTRACT

A process is proposed for the double-sided printing and/or coating of a substrate using at least one liquid or dry toner that has at least one polymer. It is provided that at least one toner layer or a first image that has at least one toner layer is transferred onto a first side of the substrate. Then, the toner is heated up to at least its glass transformation temperature, and fixed onto the substrate. In the process, the original glass transformation point of the toner shifts to a higher temperature level as a result of the cross-linking of its polymer chains, and the viscosity is increased. In a second processing step, at least one toner layer or a second image is transferred onto the second side of the substrate and heated up to a temperature that is equal to or greater than its glass transformation temperature.

14 Claims, 2 Drawing Sheets

PROCESS FOR THE DOUBLE-SIDED PRINTING AND/OR COATING OF A SUBSTRATE

FIELD OF THE INVENTION

The invention involves a process for the double-sided printing and/or coating of a substrate, in particular, of paper or cardboard, using at least one toner.

BACKGROUND OF THE INVENTION

A known process is electrostatic printing, in which a latent electrostatic image is developed by charged toner particles. These particles are transferred onto an image-receiving substrate, called substrate for short in the following. Afterwards, the developed image that has been transferred onto the substrate is fixed by the toner particles being heated up and fused. To fuse the toner particles, contacting processes are often used in which the toner particles are brought into contact with suitable devices, for example hot rollers or cylinders. It is disadvantageous that it is usually necessary to use silicone oil as a separating agent that should prevent an adhesion of the fused toner onto the heating device. In addition, the design, the maintenance and the operating costs of these heating devices that operate by contact are expensive and thus cost-intensive. Furthermore, the defect rate caused by the contacting heating devices is relatively high. In order to fix the toner that is transferred onto the paper, for example, heating devices and processes are also known that operate in a contactless manner, in which for example, the toner particles are fused using heat radiation and microwave radiation or with hot air.

In the contacting and non-contacting fusing processes, toner is used, for example, that has a glass transformation temperature ($T_G$) in a range from 45° C. to 75° C. The glass transformation temperature, at which the toner—starting from the solid state—begins to soften, can be influenced by the choice of raw materials and by the addition of certain additives to the toner. The lower value of the temperature range, in which the glass transformation point lies, is limited at the bottom by the storage conditions of the toner and the heat generated in the printer, in particular within the development station, and it is limited at the top by the fusing and fixing conditions. In a fusing device for the toner, both the toner as well as the substrate itself is heated up. In order to be able to ensure a good fixing of the toner onto the substrate, the surface temperature of the substrate must be in the range of the glass transformation temperature of the toner above it. The toner easily reaches and/or exceeds the glass transformation temperature ($T_G$) in the area of the fusing device.

Processes and devices are known in which the substrate is printed or coated double-sided, whereby for the printing of the upper side and the lower side, one and the same toner transfer device and fusing device is often used. After a first side of the substrate is printed, the substrate is automatically reversed, supplied back to the beginning of the processing line, and supplied again to the transfer device and fusing device, where the other side of the substrate is printed. While the toner located on the second side of the substrate is fused, the substrate, the image that has already been fixed on the rear side of the substrate, and the image to be fixed are heated. The second heating affects the print quality in an undesirable way, in particular the gloss of the image that has already been fixed and is located on the first side. By the repeated heating of the substrate, the gloss can change at individual locations or over the entire side of the substrate. The gloss value of the second side of the substrate is larger than on the first side of the substrate. Furthermore, the toner already fixed on the first side of the substrate tends to smudge when the second side of the substrate is heated up to a temperature that is above the glass transformation point of the toner. The renewed fusing of the toner that has already been fixed and is located on the first side of the substrate leads to errors in the printed image and to the smudged toner dirtying a transport device that conducts the substrate along the processing line. In the worst case, the substrate can adhere to the transport device. The same problems also occur in a device in which two complete print units each have a toner transfer device and a fusing device. In these known devices, a first image is transferred and fixed by a first print unit to a first side of the substrate, while subsequently a second image is transferred and fixed onto the rear side of the substrate using the second print unit.

SUMMARY OF THE INVENTION

The purpose of the invention is to produce a process in which a double-sided printing and/or coating of a substrate is possible with a simultaneously high quality of the images and/or coatings applied onto the front side and the rear side of the substrate.

In order to achieve this purpose, a process is proposed that provides for the double-sided printing and/or coating of a substrate, for example, a paper sheet or a paper web, while using at least one liquid or dry toner that has at least one polymer, at first at least one toner layer, or a first image that has at least one toner layer, is transferred onto a first side of the substrate. Then, this toner is heated up to its glass transformation temperature ($T_G$) or a temperature above it. In the process, the toner and/or the toner layers are preferably fused until a certain gloss becomes set. This state of the toner is then transformed by the fixing of the toner onto the substrate using ultraviolet radiation, for example. The toner present in the form of individual molecules has the property that its original glass transformation temperature shifts to a higher temperature level as a result of the cross-linking of its polymer chains, and the viscosity of the toner increases. In other words, after the toner has been heated up for the first time to its glass transformation point, or beyond, and cross-linked, and cooled off again, its glass transformation temperature increases so that this toner first softens at a higher temperature when it is re-heated—starting from the solid state. The cross-linking process increases the glass transformation temperature and the viscosity of the toner, so that the toner no longer becomes liquid above its new glass transformation temperature when it is re-heated, but instead it obtains a thermoplastic, rubber-like structure. After the toner has then been fixed to the first side of the substrate, at least one toner layer or a second image that has at least one toner layer is transferred to the other, second side of the substrate in the next step. The toner located on the second side of the substrate is then warmed or heated up to a temperature that is equal to or greater than its own glass transformation temperature. Next, a cross-linking of the molecules of the second toner also occurs here, which leads to the changes in the properties of the toner as described above. Since the toner already fixed onto the first side of the substrate can no longer become liquid (as mentioned), but stays highly viscous when heated above its new glass point, it can be ensured that the toner applied and fixed onto the first side of the substrate does not smudge on its support, for example, a conveyor belt or a roller, or experience a change in its gloss, by the fixing of the toner on the other, second side of the substrate.

It is especially advantageous in the process according to the invention that the temperature of the first side of the substrate and the toner fixed on it, which becomes set during the heating of the second side of the substrate in order to fix the second toner image, can also be above the new glass transformation point of the first toner image, provided the first toner image is not harmed by this. By the toner located on the first side of the substrate no longer becoming liquid when it is re-heated, it is thus possible to prevent a smudging and thus a dirtying of the printing and/or coating machine and/or copier, in which the process according to the invention is applied, by the toner applied and fixed on the first side of the substrate. It is furthermore advantageous that the quality, in particular, the gloss of the image and/or the coating applied onto the first side of the substrate remains the same and does not change when the second side of the substrate is printed or coated.

In a preferred embodiment form, the glass transformation temperature of the toner increases, because of the cross-linking of the polymer chains, by 10° C. to 20° C. and at the same time, the viscosity of the toner increases. Above the glass transformation point, the toner is no longer liquid when it is re-heated, but instead (as mentioned) obtains a thermoplastic, rubber-like structure. This and other effects cause the gloss of the first image and/or the coating on the first side of the substrate to no longer change during printing and/or coating of the second side of the substrate.

In a preferred embodiment form, a powdery dry toner is used that has a glass transformation temperature preferably in a range from 45° C. to 75° C. and a glass transformation point that shifts by approx. 10° C. to 20° C. after it is heated up for the first time above its original glass transformation temperature with subsequent cross-linking of the toner, so that the lower value of its new glass transformation temperature is in the range from 55° C. to 65° C. or higher. Especially preferred is a dry toner that is cross-linked by, and preferably exclusively by, irradiation with ultraviolet light, that has a glass transformation point above 45° C. prior to being fused for the first time and is comprised of the following components:

1. Uralac XP 3125 (polyester resin) with approx. 83 percent by weight ([symbol] 79.05% portion of total weight of the toner)
2. Uralac ZW 3307 (cross-linking agent) with approx. 17 percent by weight ([symbol] 16.19% portion of total weight of the toner)
3. Irgacure 184 (photo initiator) with approx. 1 percent by weight ([symbol] 0.95% portion of total weight of the toner) and
4. BASF Heliogon Blue 7090 (color pigment) with approx. 4 percent by weight ([symbol] 3.81% portion of total weight of the toner)

Optionally, additives to control the melt flow, the surface quality, the toner charge, the powder flow, and if necessary, additional additives are also added to the mix.

The raw materials of this toner are mixed together and molten-mixed in a heated two-roller mill, for example. The cooled-off extrudate is milled to a particle size ≧3 mm and then brought into a fluid-energy mill which pulverizes it further. Finally, the fine toner particles are sorted, whereby for the toner used in the process according to the invention, preferably particles having an average particle size of approx. 8 $\mu$m are used. The fusing of the toner for the purpose of fixing it onto its substrate is done at a surface temperature of approx. 70° C. to 120° C., at which the curing of the toner is also performed as a result of the cross-linking of the polymer chains when the fused toner is irradiated with ultraviolet light. By the cross-linking of the polymer chains, the glass transformation temperature of the toner increases by over 10° C., and its viscosity also increases. With regard to the composition of the toner, the realizable fusing process, and the fixing process, reference is made to the publication "UV-cured Toners for Printing and Coating on Paper-like Substances" by Detlef Schulze-Hagenest and Paul H. G. Binda, IS&T 13$^{th}$ Int. Congr. Adv. i. Non-Impact-Printing Technologies, 1997, the content of which has been made an object of this application.

Provided the substrate is paper, cardboard, or the like, its first side can be the front side and its second side can be the rear side. Of course, it is also possible that the first side of the substrate is the rear side and the second side of the substrate is the front side of the paper. In other words, whether the front side or the rear side of the paper is printed first can be freely chosen.

In a preferred embodiment form of the process, it is proposed that the fixing of the toner is done in a contactless manner. For this purpose, for example, a known drying oven, heat radiation and/or microwave radiation and/or hot air or the like can be used. Especially preferred is an embodiment variation in which the toner is fixed exclusively with ultraviolet radiation, i.e. is cross-linked in the fused state. The fusing of the toner can, for example, be done using or exclusively by infrared radiation, hot air, microwaves and/or the like.

Furthermore, an embodiment form of the process is preferred which is characterized in that several toners with different colors are applied onto at least one of the sides of the substrate. The image applied on one side of the substrate thus has several colors, for example, black, cyan, magenta, yellow, and/or a secondary color. With the process according to the invention, not only is a single-color print readily realizable, but also a multi-color print, whereby here it also applies that the glass transformation point of each of the toners increases after the toner is heated and fixed for the first time, for example, by up to 10° C. or more. Furthermore, the properties of the toner change, which, upon renewed heating to its now new glass transformation temperature or above it, no longer becomes liquid, but instead obtains a thermoplastic, rubber-like structure. In this way, it is ensured that during printing or coating of the second side of the substrate, the toner already fixed to the first side of the substrate does not become liquid again.

In a preferred embodiment form, up to seven toners with different colors can be transferred and fixed in order to generate the image or a coating on the substrate. Preferably, however, only four different toners with different colors, for example, the primary colors, can be applied. It is to be emphasized that in relation to the invention presented here, the term "coating" is understood to be a thin layer formed from at least one toner. A "coating" can thus also easily have several different-colored toners so that the coating can also be multi-colored.

Furthermore, an embodiment form of the process is preferred which is characterized in that the toners at first are all applied onto the respective side of the substrate in order to generate a coating or an image and then heated together and fixed. Thus, on each of the two sides of the substrate, respectively, only one fixing operation is performed. In another embodiment example, it is planned that on at least one of the sides of the substrate, several fixing operations are performed in order to generate the image or coating. For example, after each transfer of a toner layer onto a side of the substrate, it can then be fixed immediately onto the substrate, whereby then in a subsequent step, the next toner layer is applied onto the substrate, which in turn is fixed immediately after that. Of course, for example, at first two toner layers can also be applied onto a side of the substrate which then are fused together and fixed, whereby in a subsequent process step on the same side of the substrate, an additional toner layer is transferred onto the toner layers that have already been fixed, and this toner layer is then bonded with the substrate in a subsequent separate fixing operation.

In a preferred embodiment form, the process according to the invention can be used in conjunction with a digital printing machine, i.e. a machine that operates, for example, according to the electrographic or electrophotographic process. The process can be applied fundamentally anywhere that using at least one toner, a substrate is coated or an image is transferred to a substrate and fixed there. The printing machine can thus also be a copier.

Additional advantageous embodiment forms of the process result from the remaining subordinate claims.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENTS

Figure 1:
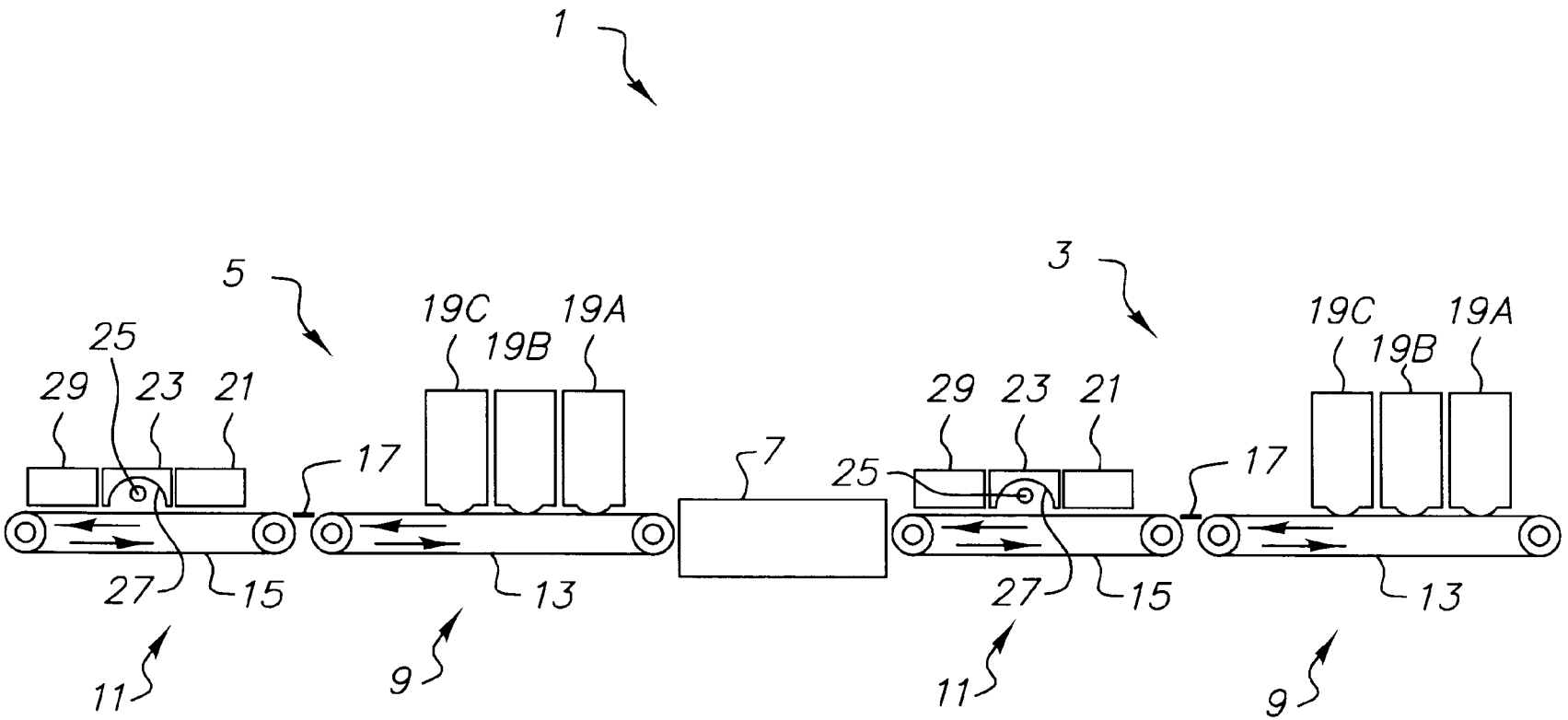
FIG. 1 is a section of a first embodiment example of a printing machine for performing the process according to the invention.

FIG. 1 shows, in a schematic diagram, a section of a first embodiment example of a machine 1 for the two-sided printing and/or coating of substrates. In the following, it is assumed purely for the purposes of an example that paper sheets are used as the substrates, and on their front side and rear side, an image and/or coating is produced. In the process, at least one curable toner is applied onto the substrate, heated up beyond its glass transformation temperature, and then fixed onto the substrate by impingement with UV-rays. In the following, it is assumed that using the machine 1, a first image is applied onto the first side of the paper sheet and a second image is applied onto the second side of the paper sheet.

Machine 1 contains a first print unit 3 to generate a first image on the first side of the paper sheet, for example, the front side, and a second print unit 5 for printing the second side of the paper sheet. Between the print units 3, 5 is a reversing device 7 for the paper sheets arranged one after the other in the transport direction, and possibly at a distance from each other, the function of which is explained later in greater detail. The construction and the function of the first and second print units 3, 5 is identical in this embodiment example, so that in the following only the first print unit 3 is described in greater detail.

The first print unit 3 contains a first transport device 9 for the paper sheets, which is arranged after a second transport device 11 in the sheet transport direction. The transport devices 9, 11 each have at least two idler rollers, over which at least one endless conveyor belt 13 and/or 15 is conducted. In the transfer area between the transport devices, a guide element 17 is arranged. As can be seen by the running direction of the conveyor belts 13, 15, indicated with arrows in FIG. 1, the paper sheets are transported from right to left in the diagram according to FIG. 1. The speeds of the first and the second transport devices can be variably high.

Above the first transport device 9, several image production and transfer devices 19A, 19B, 19C and 19D are arranged in this embodiment example, which each function for the transfer of respectively one toner and/or one toner layer of different color onto paper sheets that lie on the conveyor belt 13 and are guided past the image production and transfer devices 19. After all toner layers have been transferred onto the first side of the paper sheet, the first image is developed completely on the paper sheet using the toner and can then be fixed onto the paper sheet in a subsequent processing step. For this purpose, above the second transport device 11, a heating device 21 is provided, which impinges the paper sheets, with the toner particles located on them, with infrared rays, hot air and/or microwaves or the like, and heats them above their glass transformation temperature $T_G$. A curing device 23 is arranged after the heating device 21, and this curing device 23 in this embodiment example has a lamp 25 that is surrounded by a reflector 27. The lamp 25 impinges the image to be fixed with ultraviolet rays, as a result of which the polymer chains of the fused toner become cross-linked. By the cross-linking, the glass transformation temperature and the viscosity of the toner increase.

After the curing device 23, a cooling unit 29 is arranged which cools off the paper sheets and the image fixed onto it. Then, the paper sheet is guided over the reversing device 7, which turns the paper sheet and guides it over to the subsequent second print unit 5. Under "reversing the paper sheet", it is understood that the position of the upper side and the lower side of the paper sheet are exchanged, so that next, in the subsequent second print unit 5, the second side of the paper sheet, which, when running through the first print unit 3, lay on the conveyor belts 13, 15 of the transport devices 9, 11, and now lies to the top and can be printed. The print operation occurring in the second print unit 5 is identical to the print operation described with the previous first print unit 3, so that reference is made to the previous embodiments in this regard.

Figure 2:
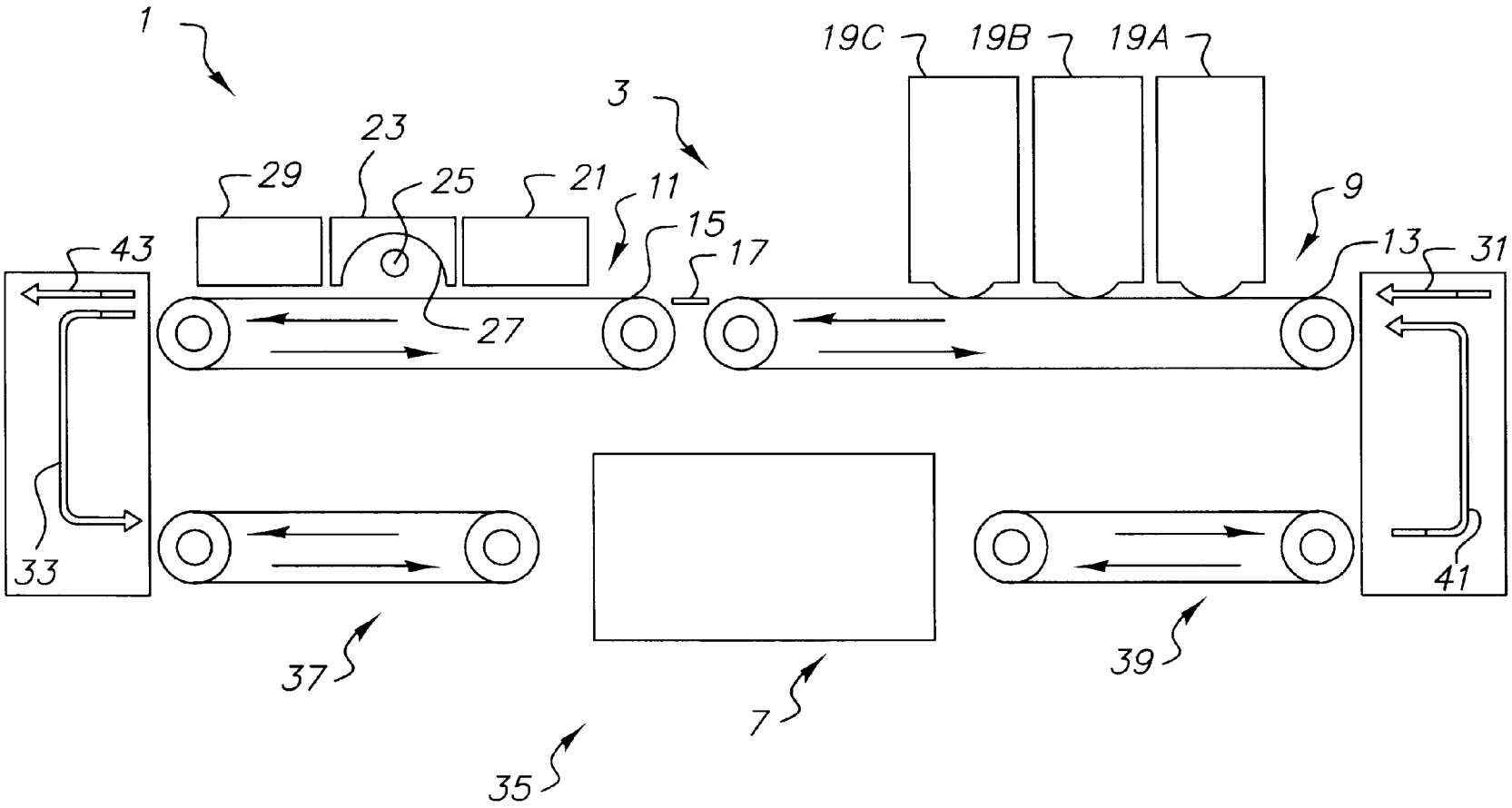
FIG. 2 is an additional embodiment example of the printing machine.

FIG. 2 shows another embodiment example of machine 1. The same parts are provided with the same reference indicators, so that reference is made to the description for FIG. 1 in this regard. In the following, only the differences are explained in greater detail. Machine 1 has only a single print unit 3, with which both the front side as well as the rear side of the paper sheet are printed. As indicated with an arrow 31, a paper sheet (not shown) is guided to the print unit 3, in which at first the first side of the paper sheet, lying to the top on the conveyor belts 13, 15, is printed with a first image. At the end of the print unit 3, the paper sheet printed on one side as indicated with an arrow 33 is guided to a reversing area 35 that is located here, purely for purposes of example, below the first and second transport devices 9, 11. In the reversing area 35, a third transport device 37, the reversing device 7 and a fourth transport device 39 is arranged. The paper sheet printed on one side is guided on by the third transport device 37 to the reversing device 7, by which the position of the upper side and the lower side of the sheet are exchanged. From the reversing device 7, the paper sheet is then passed on to the fourth transport device 39. The first side of the paper sheet thus lies on top on the conveyor belt of the transport device 11, on the bottom on the conveyor belt of the transport device 37, and again on top on the conveyor belt of the third transport device 39. From the fourth transport device 39, the paper sheet reaches, as indicated with an arrow 41, the beginning of the print unit 3 and is passed on to the first transport device 9. The paper sheet then runs through the print unit 3 a second time, whereby now the second side of the paper sheet lies to the top on the conveyor belt 13 and is printed with an image. After the paper sheet has left the print unit 3 for the second time, it is, as indicated by an arrow 43, guided out of the "transport and treatment loop" of print unit 3.

Common to the embodiment examples of the machine 1 shown in FIGS. 1 and 2 is that either at first the front side of the paper sheet and then its rear side, or that at first in a first processing step, the rear side of the paper sheet, and only then its front side, is printed. Furthermore, in an advantageous embodiment example (not shown) it is provided that the paper sheets, after their first side has been printed, are stored intermediately for a certain time period in a storage unit. This means the printing of the second side of the paper sheet is not done here immediately after the printing of the first side of the paper sheet, as in the embodiment examples according to FIGS. 1 and 2. The reversing device 7 can be arranged before the storage unit or as seen in the paper transport direction after the storage unit.

The image production and transfer devices 19A to 19D can each be constructed so that the toner is transferred directly by a photoconductor (not shown), for example, by an electrographic or electrophotographic image cylinder, onto the paper. As an alternative, it is possible that the toner is guided at first onto an intermediate transfer device and only then from it onto the paper. The intermediate transfer device can be used as a transfer device for only one color or for all colors. Therefore, it is possible that for each color and/or for each toner, one intermediate transfer device is provided.

The toner used in machine 1 can be dry or liquid. If liquid toner is used, organic or inorganic liquid can be used as the carrier liquid for the toner.

In an advantageous embodiment example it is provided that the curing device 23 does not impinge the fused toner with ultraviolet light in an uninterrupted manner, but instead that it emits light flashes, whereby its UV-ray emission is sufficiently high in order to ensure a desired cross-linking of the polymer chains of the toner and/or the toners. As a alternative or in addition, heat radiation or a combination of fusing and curing of the toner using heat can be used to cure the toner.

The process according to the invention is readily ascertained from the description on the FIGS. 1 and 2. It consists in that the printing and/or coating of the front side and rear side of the substrate is done in two processing steps that are independent of each other. In the first processing step, at least one toner layer or the first image is transferred onto a first side of the substrate. After that, the toner is heated to its glass transformation temperature, or a temperature above it, and begins to melt. Preferably by UV-radiation (ultraviolet rays), the polymer chains of the toner begin to cross-link and become longer. By the fixing of the toner (described above) onto the substrate, the initial glass transformation point of the toner changes as a result of the cross-linking of its polymer chains, and to be precise, in such a manner that it increases, i.e., is greater than it was before the first fusing and curing. In the second processing step, at least one toner layer or a second image is transferred onto the second side of the substrate, then it is heated to a temperature that is equal to or is greater than the glass transformation temperature of the toner. By the heating of the second toner image to its glass transformation temperature, the toner image that is located on the first side of the substrate and already fixed can be heated to a temperature that is easily even above the new glass transformation temperature of the toner located on the first side of the substrate. Smudging of the toner fixed onto the first side of the substrate onto a support, for example, a conveyor belt or roller, as a result of a relative movement between the support and the substrate, can be ruled out, since the first toner image no longer becomes liquid because of the cross-linking of its toner material, also during heating even above its glass transformation temperature, but instead it obtains a rubber-like structure.

A negative influence of the toner fixed on the first side of the substrate during printing and the associated heating of the second side of the substrate thus does not occur. Dirtying of the transport devices, as they are described, for example, using FIGS. 1 and 2, can thus be ruled out with certainty. Furthermore, the first image on the first side of the substrate is not affected by the second printing process, so that the image quality, in particular, the gloss of the first image is preferably not influenced by printing the second side of the substrate, or at the least, it is only influenced to a very small extent.

As described above, a liquid toner, which is located in an organic or inorganic liquid or dissolved in one, can also be used for the process according to the invention.

The embodiment examples are not to be understood as a restriction of the invention. Moreover, numerous alterations and modifications are possible in the context of the disclosure presented, in particular such variations, elements and combinations and/or materials, which, for example, by the combination or modification of individual characteristics and/or elements or process steps, described in connection with the general description and embodiment forms as well as claims, and contained in the drawings, can be ascertained by the expert in regard to the solution of the purpose and lead, through combinable characteristics, to a new object or to new process steps and/or process step sequences.

PARTS LIST

1 Machine
3 First print unit
5 Second print unit
7 Reversing device
9 First transport device
11 Second transport device
13 Conveyor belt
15 Conveyor belt
17 Guide element
19 Image production and transfer device
21 Heating device
23 Curing device
25 Lamp
27 Reflector
29 Cooling unit
31 Arrow
33 Arrow
35 Return guide area
37 Third transport device
39 Fourth transport device
41 Arrow
43 Arrow

What is claimed is:

1. Process for the double-sided printing and/or coating of a substrate, in particular, of paper or cardboard, while using at least one liquid or dry toner that has at least one polymer, with the following steps:

transfer of at first at least one toner layer or a first image that has at least one toner layer onto a first side of the substrate;

the toner is heated up to at least its glass transformation temperature, fixing of the toner onto the substrate, whereby the original glass transformation point of the toner shifts to a higher temperature level as a result of the cross-linking of its polymer chains;

transfer of at least one toner layer or a second image that has at least one toner layer onto the other, second side of the substrate; and heating of the toner located on the second side of the substrate up to a temperature that is equal to or greater than its glass transformation temperature.

2. The process according to claim 1, characterized in that, the heating of the toner is done in a contactless manner, preferably using one of the group consisting of heat and/or microwave radiation and/or hot air.

3. Process according to claim 1, characterized in that, the cross-linking of the toner is done using UV (ultraviolet) rays.

4. Process according to claim 1, characterized in that, the toner is cooled after it has been fixed onto the substrate.

5. Process according to claim 4, characterized in that, the substrate is stored for a certain time period intermediately after transfer, heating and fixing and cooling of the coating or first image that was applied onto the first side of the substrate, and before a coating or the second image is applied onto the second side of the substrate.

6. Process according to claim 1, characterized in that up to seven toners with different colors are applied onto at least one of the sides of the substrate.

7. Process according to claim 6, characterized in that, the toners are at first all transferred onto the respective side of the substrate and then heated together and fixed.

8. Process according to claim 6, characterized in that, several fixing operations are performed to produce the image or the coating on at least one of the sides of the substrate.

9. Process according to claim 8, characterized in that, after each transfer of a toner layer onto a side of the substrate, the toner layer is fixed onto the substrate immediately afterwards, and that in a subsequent step, the next layer of toner is transferred onto the substrate and/or the previously fixed toner layer and then fixed.

10. Process according to claim 8, characterized in that, the at least one toner layer is fused and impinged with ultraviolet light to cross-link the polymer chains.

11. Process according to claim 10, characterized in that, the UV-radiation is timed to create UV-light flashes.

12. Process according to claim 1, characterized in that, to cross-link the polymer chains, the toner is impinged with heat radiation.

13. Process according to claim 1, characterized in that, the fusing of the toner and the cross-linking of the polymer chains is done by supplying heat.

14. Process according to claim 1, characterized in that, it can be used in conjunction with one of the group consisting of a digital printing machine, copying machine, or coating machine.

* * * * *